US005745104A

United States Patent [19]

Minoura

[11] Patent Number: 5,745,104

[45] Date of Patent: Apr. 28, 1998

[54] PALETTE CONTROL CIRCUIT

[75] Inventor: Hiroshi Minoura, Inagi, Japan

[73] Assignee: Fujitsu Limited, Kawasaki, Japan

[21] Appl. No.: 868,538

[22] Filed: Jun. 4, 1997

Related U.S. Application Data

[63] Continuation of Ser. No. 673,097, Jul. 1, 1996, abandoned, which is a continuation of Ser. No. 385,580, Feb. 8, 1995, abandoned, which is a continuation of Ser. No. 113,913, Aug. 31, 1993, abandoned.

[30] Foreign Application Priority Data

Aug. 31, 1992 [JP] Japan ..... 4-230662

[51] Int. Cl.[6] ..... G09G 5/06

[52] U.S. Cl. ..... 345/199; 345/150

[58] Field of Search ..... 345/199, 185, 345/186, 200, 197, 203, 150, 152, 153, 187, 188

[56] References Cited

U.S. PATENT DOCUMENTS

| | | | |
|---|---|---|---|
| 4,183,046 | 1/1980 | Dalke et al. | 345/199 |
| 4,484,187 | 11/1984 | Brown et al. | 345/199 |
| 4,853,681 | 8/1989 | Takashima | 345/199 |
| 4,975,861 | 12/1990 | Fujimoto | 345/199 |
| 5,083,257 | 1/1992 | Kennedy | 345/199 |
| 5,140,312 | 8/1992 | Ishii | 345/199 |

FOREIGN PATENT DOCUMENTS

| | | |
|---|---|---|
| 59-178493 | 10/1984 | Japan . |
| 60-165695 | 8/1985 | Japan . |
| 63-29793 | 2/1988 | Japan . |
| 01-137289 | 5/1989 | Japan . |
| 2-204781 | 8/1990 | Japan . |
| 03-148696 | 6/1991 | Japan . |

*Primary Examiner*—Xiao Wu
*Attorney, Agent, or Firm*—Staas & Halsey

[57] ABSTRACT

An object of the present invention is to realize a palette control circuit which generates inconspicuous noise using simple circuitry and without reducing processing efficiency. A palette control circuit comprises a palette 5 used for color conversion, a selector 4 that is connected to the address input of the palette and selects image memory output or address data for use in accessing the palette, a holding circuit 6 for temporarily holding the output of the palette 5, and a control circuit 7 for issuing an input select instruction to the selector 4, access control signals to the palette 5, and a data holding instruction to the holding circuit 6. For displaying normal image memory, the control circuit 7 instructs the selector 4 to select image memory output and allows the holding circuit 6 to pass palette output as it is. For accessing the contents of the palette, the control circuit 7 instructs the holding circuit 6 to hold the preceding output of the palette 5 and allows the selector 4 to select address data for use in accessing the palette.

9 Claims, 4 Drawing Sheets

RAM
ADR
WR
RD
D
R
G
B
5
8BIT
REGISTER
22
26
SELECTOR
4
21
24
25
BUFFER
16
18
PALETTE WRITING DATA
PALETTE ADDRESS DATA
PIXEL DATA FROM IMAGE MEMORY
CONTROL CIRCUIT
7
31
32
33
34
12
14
15
13
10
11
WRITING INSTRUCTION
READING INSTRUCTION

PALETTE CONTROL CIRCUIT

This application is a continuation of application Ser. No. 08/673,097, filed Sep. 1, 1996, now abandoned, which is a continuation of application Ser. No. 08/385,580, filed Feb. 8, 1995, now abandoned, which is a continuation of application Ser. No. 08/113,913, filed Aug. 31, 1993, now abandoned.

BACKGROUND OF THE INVENTION

1. Field of the Invention

The present invention relates to a palette control circuit for use in performing color or density conversion on picture data or image data for a display unit.

The number of colors treated by a personal computer, a workstation, an image processor or the like was eight initially and has increased by stages to 16 million. Now, a full-color image consisting of 16 million colors can be displayed. With the increase in the number of color to be treated, the amount of data to be processed has increased. This necessitates a high-capacity memory and a high throughput speed. A palette is a solution of these problems.

A palette is a kind of code converter provided between an image memory (display memory) and a digital analog converter (hereinafter, DAC). The palette is a high-speed low-capacity memory for use in converting colors or densities into other forms when data stored in image memories are to be displayed. For example, when an 8-bit display memory is used, 256 colors or a gradation of 256 levels alone can be displayed. When a high-speed memory (palette) having a capacity of 256 24-bit words is employed for code conversion, 256 colors can be selected freely from 16,777,216 colors.

The capabilities of a palette are helpful in using multiple colors, as mentioned above. Moreover, color conversion can be performed instantaneously by rewriting the contents of a palette. Screen conversion can be performed smoothly by rewriting the contents of a display memory. The palette can also apply to animation.

In an image processor having a large-capacity display memory, the palette is useful in providing easy-to-see images by performing density, or contrast conversion, enhancement concerning a specific density.

2. Description of the Related Art

In a conventional palette control circuit, when the contents of a palette are rewritten, or are read for confirmation, control is extended so that the palette is either accessed without regard to image display or the palette is accessed according to a timing signal provided by a display control circuit only during flyback time or when images are otherwise not displayed.

The palette control circuit permitting the former access is of a simple type. However, while a palette is being accessed, irrelevant data is supplied as the output of the palette and appears as noise in the screen.

The palette control circuit permitting the latter access does not cause noise to appear in a screen. However, a request for access to a palette is placed in the wait state until a flyback time or other non-display period comes. This results in reduced efficiency of a processor or complex circuit control.

SUMMARY OF THE INVENTION

An object of the present invention is to realize a palette control circuit, which generates inconspicuous noise, using simple circuitry without reducing processing efficiency.

To achieve the above object, the present invention provides a palette control circuit for an image display unit comprising a palette used for color or density conversion, a selector that is connected to an address input of the palette and selects image memory output or address data for use in accessing the palette, a holding circuit for temporarily holding the output of the palette, and a control circuit that issues an input select instruction to the selector, an access control signal to the palette, and a data hold instruction to the holding circuit. For displaying a normal image memory output, the control circuit instructs the selector to select an image memory output and allows the holding circuit to pass the palette output as it is. For accessing the palette, the control circuit instructs the holding circuit to hold the preceding palette output and allows the selector to select address data for use in accessing the palette.

DESCRIPTION OF THE PREFERRED EMBODIMENTS

Figure 1:
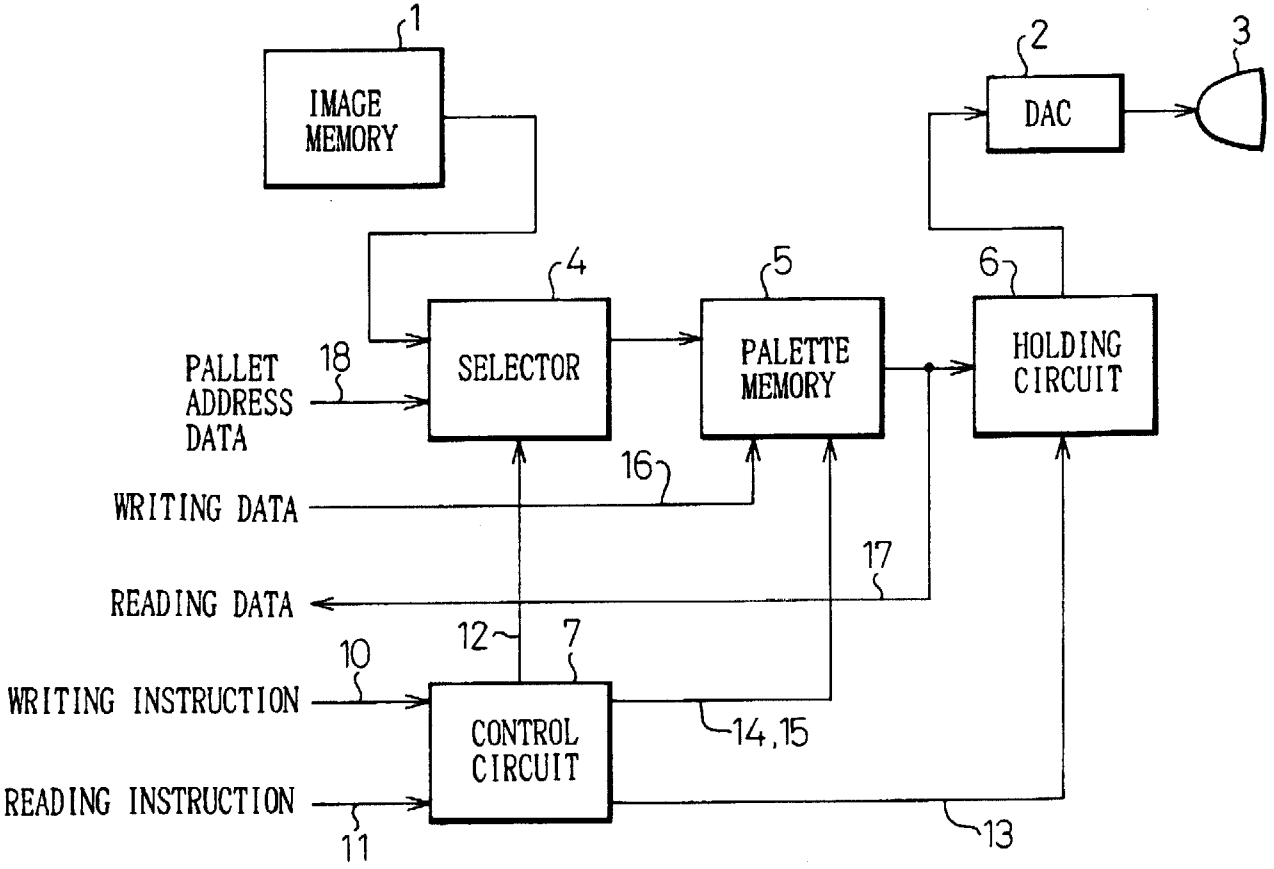
FIG. 1 is a block diagram showing the principle of the present invention.

Prior to addressing detailed embodiments of the present invention, the principle of the present invention will be described. FIG. 1 is a block diagram showing the principle of the present invention.

In FIG. 1, reference numeral 4 denotes a selector for selecting image data or picture data read from an image memory 1 or an access address. A palette memory 5 converts colors or densities of pixels specified in image data or picture data into other forms according to the data stored therein and then outputs the converted data. 6 denotes a holding circuit that normally passes the output of the palette 5 and, in response to an instruction, holds the output. 7 denotes a control circuit for controlling the above circuits by issuing a data hold signal 13 to the holding circuit 6, a select signal 12 to the selector 4, or access control signals 14 and 15 to the palette 5.

The output of the holding circuit 6 is fed to a DAC 2, and then passed to a display 3. Images and other data are then displayed.

For displaying normal image memory output, the control circuit 7 instructs the selector 4 to select image memory output and allows the holding circuit 6 to pass the output of the palette 5 as it is.

Only when the contents of the palette 5 are to be accessed according to a write instruction 10 or a read instruction 11, a hold signal 13 is issued so that the holding circuit 6 will hold the preceding output of the palette 5. In response to the select signal 12, the selector 4 selects address data 18 for use in accessing the palette 5.

In this state, the write signal 14 or read signal 15 is issued to the palette. Thus, write data 16 is written or read data 17 is read.

When palette writing or reading terminates, the control circuit 7 issues the select signal 12 to instruct the selector 4 to select image memory output. The control circuit 7 drops the hold signal 13 to allow the holding circuit 6 to pass the output of the palette 5 as it is.

Owing to the aforesaid components, while the palette 5 is being accessed, the preceding image data appears on the display 3. Unlike a display screen which is disturbed with the pixels of different colors or densities resulting from the output of totally irrelevant data, produced by a conventional palette control circuit, the display screen produced by the invention control circuit of the shows inconspicuous noise or substantially no noise.

Referring to the drawings, embodiments of the present invention will be described below.

Figures 2, 2A, 2B:
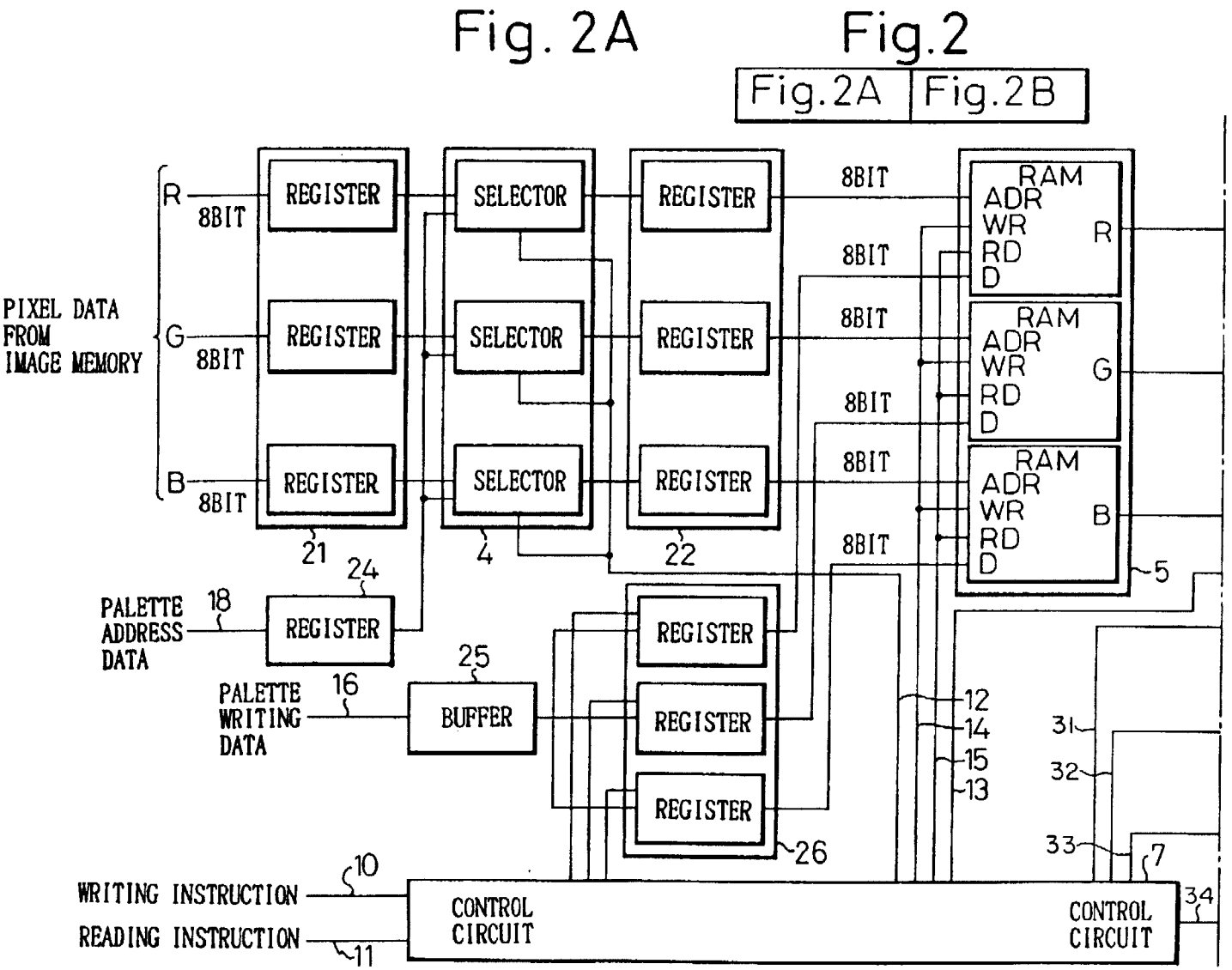
FIG. 2A and FIG. 2B are block diagrams showing a major portion of an embodiment of the present invention.
Figure 2B:
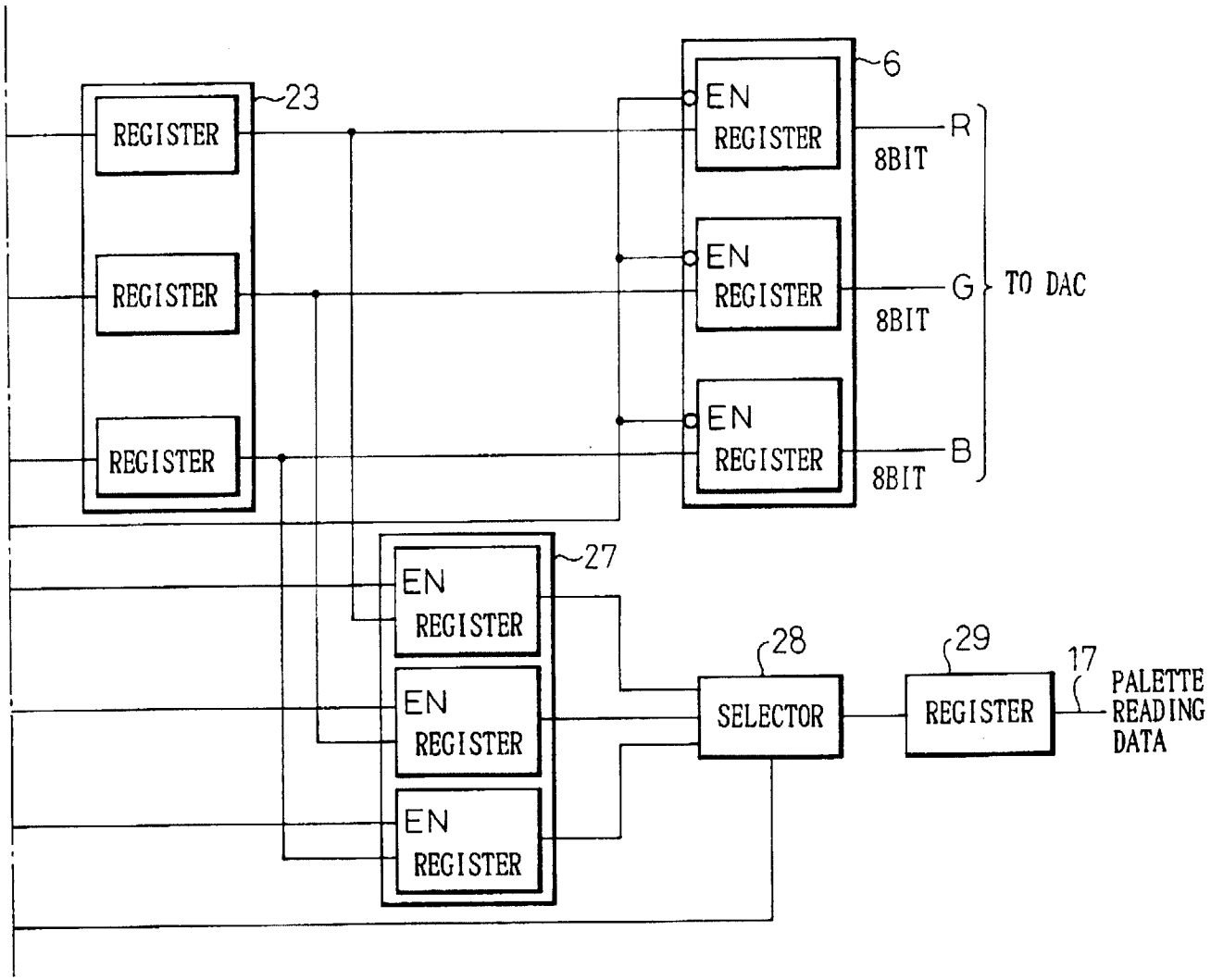

FIGS. 2A and a 2B, in the composite, comprise a block diagram showing a major portion of an embodiment of the present invention. Components identical to those in FIG. 1 will bear the same reference numerals.

In FIG. 2A and FIG. 2B, reference numeral 4 denotes selectors for selecting picture data ("PIXEL DATA") read from image memories or address data of palettes ("PALETTE ADDRESS DATA"). 5 denotes palettes. 6 denotes holding circuits for holding the output of the palettes. 7 denotes a control circuit for generating signals for controlling these circuits.

Registers 21 and 22, respectively preceding and succeeding the selectors 4, and registers 23, succeeding the palettes 5, are buffers for use in handling high-speed signals having clock periods of several tens of nanoseconds.

In this embodiment, a pixel is composed of eight bits of red, eight bits of green, and eight bits of blue (a total of 24 bits) in image memories. The selectors 4, palettes 5, and holding circuits 6 therefore constitute three groups.

Three palettes handle red, green, and blue data, respectively, each of which has a capacity of 256 8-bit words. 24-bit pixel data (16 million colors) is therefore converted into 24-bit pixel data of different colors.

In another embodiment, image memories store 4-bit red, green, and blue data (a total of 12 bits) respectively, and three palettes, each having a capacity of 16 8-bit words, are installed for handling red, green, and blue data. 12-bit pixel data (4,096 colors) is therefore converted into 24-bit pixel data (16 million colors).

Figure 3:
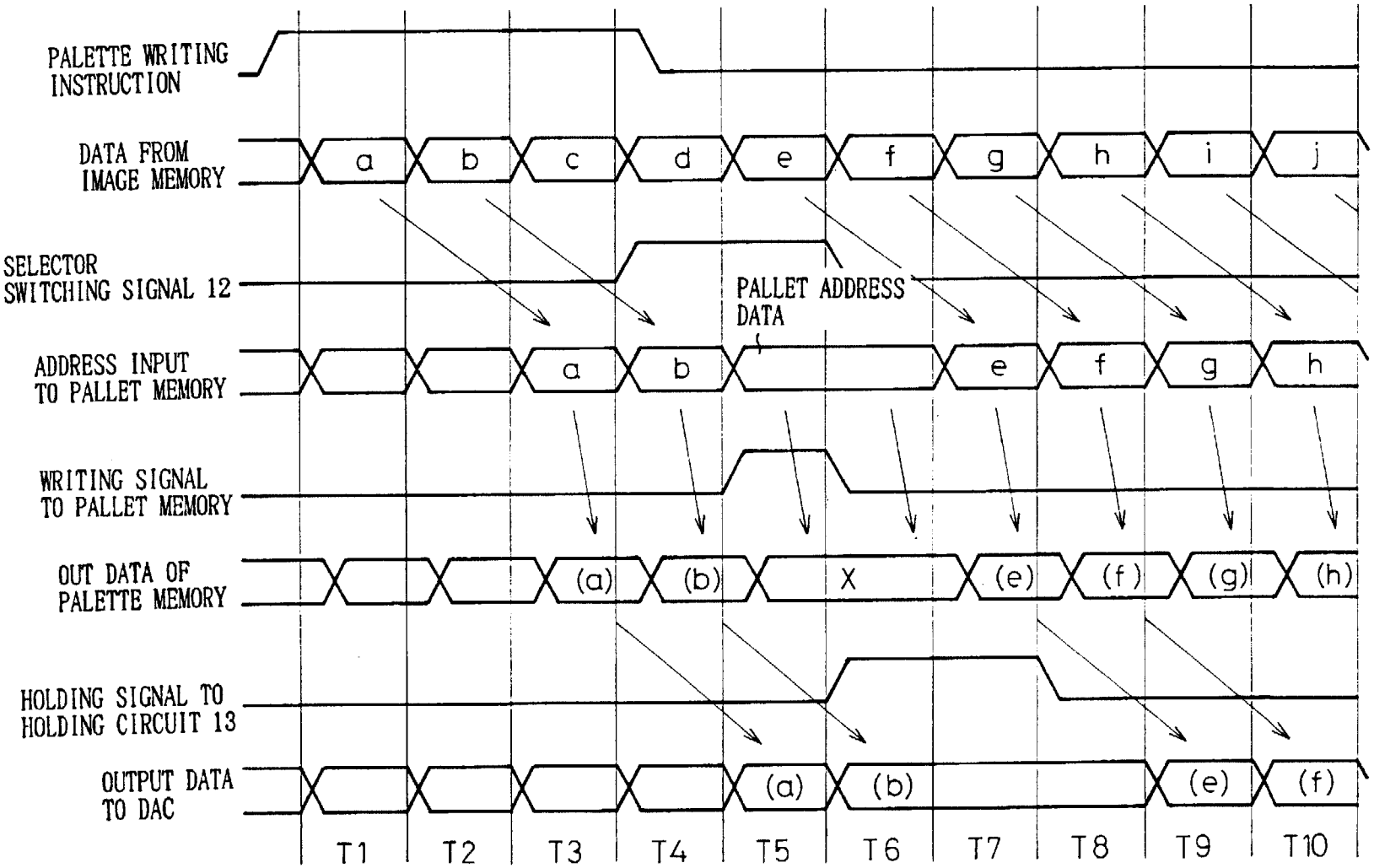
FIG. 3 is a timing chart in an embodiment of the present invention.

FIG. 3 is a timing chart for explaining the operation of this embodiment.

Pixel data a, b, c, d, etc., and j read from image memories are, as shown in FIG. 3, fed with every pixel clock pulse. When the select signal 12, issued to the selectors 4 specifies image memory data, pixel data passes through the registers 21 and 22 in two stages and lags by two clock pulses. As a result, pixel data a, b, and e, f, etc. are fed as address inputs to the palettes 5. The corresponding contents of the palette (a) and (b), and (e), (f), etc. are output. Since the hold signal 13 has not been issued to the holding circuits 6, the outputs are supplied to the DAC 2 as they are (T1 to T6).

The operation of rewriting the contents of palettes will be described below.

Under the control of a CPU, an address defined by palette address data 18 in the palette, which should be rewritten, and write data 16 are pre-set in registers 24 and 25.

When the CPU issues a palette write instruction 10 to the control circuit 7, the control circuit 7 outputs a select signal 12 to the selectors 4, a write signal 14 to the palettes 5, and a hold signal 13 to the holding circuits 6 according to the specific timing.

With the select signal 12 issued to the selectors, the palette address data 18 is supplied as address input to the palettes 5 via the registers or buffers in one stage (T5 and T6).

The contents of the palettes 5 are rewritten according to the write signal 14 issued to the palettes. The outputs of the palettes 5 are not pixel data but noise X (T5 to T7). In response to the hold signal 13, the holding circuits 6 hold the preceding data (b) (T7 and T8).

The contents of the palettes (c) and (d) corresponding to the pixel data c and d are not displayed as picture data. The preceding data (b) is displayed instead. The value of the data (b) does not differ greatly from the value of the succeeding data so no obvious influence is therefore visible.

When palette writing is completed, the control circuit 7 issues the select signal 12 to instruct the selectors 4 to select image memory output. The control circuit 7 drops the hold signal 13, thus allowing the holding circuit 6 to pass the output of the palettes 5 as they are.

The operation of rewriting the contents of the palette has been described above. The operation of reading the contents of the palette is performed similarly.

In response to the palette read instruction 11 sent from the CPU, the control circuit 7 issues the select signal 12 to the selectors 4, the read signal 15 to the palettes 5, the hold signal 13 to the holding circuits 6, select signals 31 to 33 to read data registers 27, and a select signal 34 to a selector 28 according to a specific timing.

With the select signal 12 issued to the selectors, the inputs to the palettes 5 are changed from image memory output to palette address data 18. Data is read from an address specified in the palette address data 18 in each of the palettes 5 and output to the registers 27 via the register 23.

The contents of one of three registers 27 selected by the selector 28 are supplied as palette read data 17.

In the meantime, the palettes 5 supply output different from image memory output. The preceding data held by the holding circuits 6 are output as picture data to the DAC 2. No obvious influence is visible in a screen on the display 3.

When palette reading terminates, the control circuit 7 changes the select signal 12 so that the selector 4 will select image memory output. The control circuit 7 drops the hold signal 13 and select signals 31 to 33, thus allowing the holding circuits 6 to pass the output of the palettes as they are.

As described so far, according to the present invention, when a palette is to be accessed, pixel data supplied immediately before the access is held. During palette access, the held data is displayed in a screen on a display. Totally irrelevant data will not appear in a screen on the display and noise is inconspicuous. Thus, a palette control circuit that generates substantially no noise can be realized with relatively simple circuitry.

I claim:

1. A palette control circuit for an image display unit which processes pixel data of images to be displayed, comprising:

a selector for selectively switching one of an image memory output, successive pixel data of which is output at respective, successive fixed periods, and address data;

a palette, operatively connected to said selector, for converting said image memory output into either color or density, and for performing a read or a write operation therein in accordance with an address output from said selector when an access signal is output;

a holding circuit, operatively connected to said palette, for normally outputting an output of said palette for a period corresponding to an individual said fixed period and in response to and only when a data hold signal is received thereby, for outputting an output of said palette for a period corresponding to an output period of said data hold signal and an individual said fixed period; and a control circuit, operatively connected to said selector, said palette and said holding circuit, for outputting said data hold signal to said holding circuit when said access signal is output to said palette.

2. A palette control circuit according to claim 1, further comprising:

a digital to analog converter; and a display, said digital to analog converter and said display being connected to an output of said holding circuit.

3. A palette control circuit according to claim 1, further comprising registers for handling high-speed signals connected to the inputs and the outputs, respectively, of said selector and said palette.

4. A palette control circuit for an image display unit which processes pixel data of images to be displayed, comprising:

three palettes, each used for a selected one of color and density conversion;

three selectors, connected to address inputs of said three palettes, for selecting one of an image memory output, successive pixel data of which is output at respective, successive fixed periods, and address data for use in accessing said three palettes;

three holding circuits, operatively connected to said three palettes, for normally outputting respective outputs of said three palettes for a common period corresponding to an individual said fixed period and, in response to and only when a data hold signal is received thereby, outputting respective outputs of said three palettes for a common period corresponding to an output period of said data hold signal and an individual said fixed period; and a control circuit for issuing an input select signal to said three selectors, access control signals to said three palettes, and the data hold signal to said three holding circuits, said control circuit instructing said three selectors to select image memory outputs and to allow said three holding circuits to pass said outputs of said three palettes, as they ares for displaying normal image memory output, said control circuit also instructing said three holding circuits to hold the preceding outputs of said three palettes and to allow said three selectors to select address data for use in accessing the contents of said palettes.

5. A palette control circuit according to claim 4, further comprising:

a digital-analog converter; and a display, said digital to analog converter and said display being connected to the outputs of said three holding circuits.

6. A palette control circuit according to claim 4, further comprising registers for handling high-speed signals, connected to inputs and outputs of said three selectors and said three palettes.

7. A palette control circuit for an image display unit which processes pixel data of images to be displayed, comprising:

three selectors for selectively switching one of an image memory output, successive pixel data of which is output at respective, successive fixed periods, and address data;

three palettes, operatively connected to said three selectors, for converting said image memory output into either color or density, and for performing a read or write operation therein in accordance with an address output from said selector when an access signal is output;

three holding circuits, operatively connected to said three palettes, for normally outputting respective outputs of said three palettes for a period corresponding to said fixed period, and, in response to and only when a data hold signal is received thereby, outputting selected, respective said outputs of said three palettes for a composite period corresponding to an output period of said data hold signal and an individual said fixed period;

a selector, connected to the outputs of said three palettes, for selecting one of outputs of said three palettes; and a control circuit, operatively connected to said three selectors connected to the address inputs of said three palettes, said three palettes, and said three holding circuits, for outputting data to said three holding circuits when said access signal is output to said three palettes.

8. A palette control circuit according to claim 7, further comprising:

a digital to analog converter; and a display, said digital to analog converter and said display being connected to the respective outputs of said three holding circuits.

9. A palette control circuit according to claim 7, further comprising registers for handling high-speed signals connected to the inputs and the outputs, respectively, of said three selectors connected to the inputs of said three palettes and to the outputs of said three palettes.

* * * * *